US005226644A

United States Patent [19]

Stone

[11] Patent Number: 5,226,644

[45] Date of Patent: Jul. 13, 1993

[54] ELLIPTICAL POCKET BILLARD TABLE

[76] Inventor: Richard D. Stone, 5601 Indiana St., Golden, Colo. 80403

[21] Appl. No.: 822,533

[22] Filed: Jan. 17, 1992

[51] Int. Cl.[5] ..... A63D 15/00

[52] U.S. Cl. ..... 273/3 A

[58] Field of Search ..... 273/2, 3 R, 3 A, 6

[56] References Cited

U.S. PATENT DOCUMENTS

| | | | |
|---|---|---|---|
| D. 7,165 | 2/1874 | Held . | |
| D. 39,173 | 3/1908 | Pearson . | |
| 208,539 | 10/1878 | Reesch . | |
| 606,546 | 6/1898 | Hayes . | |
| 675,273 | 5/1901 | Fuller . | |
| 2,219,675 | 10/1940 | Gillespie | 273/2 |
| 2,361,471 | 10/1944 | Fontaine, Jr. | 273/123 |
| 3,463,489 | 8/1969 | Tretow | 273/9 |
| 3,610,618 | 10/1971 | Wiggins . | |
| 4,147,345 | 4/1979 | McGovern . | |

FOREIGN PATENT DOCUMENTS

| | | | |
|---|---|---|---|
| 16065 | of 1905 | United Kingdom | 273/3 A |
| 9543 | of 1907 | United Kingdom | 273/3 A |
| 18336 | of 1907 | United Kingdom | 273/3 A |

*Primary Examiner*—Theatrice Brown

*Attorney, Agent, or Firm*—John E. Reilly

[57] ABSTRACT

A pocket billiard table is made up of an elliptical playing surface having an outer cushion member surrounding the playing surface and ball pockets recessed into the cushion member and which are closely grouped along the intermediate area and away from opposite ends of the playing surface.

11 Claims, 1 Drawing Sheet

ELLIPTICAL POCKET BILLARD TABLE

This invention relates to the game of billiards; and more particularly relates to a novel and improved pool table of generally elliptical or oval-shaped configuration in which ball pockets are selectively spaced along the intermediate playing area of the table.

BACKGROUND AND FIELD OF THE INVENTION

The game of billiards dates back to ancient times and traditionally employs a generally rectangular snooker or billiard table with or without ball pockets at the corners and midpoints, although other table configurations have been devised. Among others, there are circular, elliptical and eight-sided table configurations wherein the ball pockets are either formed in an intermediate portion of the playing surface away from the cushion or evenly spaced around the cushioned edge of the playing surface. Representative patents are C. F. A. Reesch U.S. Pat. No. 208,539, P. L. Hayes No. 606,546, C. W. Fuller, No. 675,273, J. C. Gillespie No. 2,219,675, V. J. Fontaine, Jr. No. 2,361,471, A. Tretow No. 3,463,489, K. Wiggins No. 3,610,618, J. R. McGovern No. 4,147,345, J. J. Pearsons Des. No. 39,173 and F. E. Held Des. No. 7,165.

To the best of my knowledge, no one has satisfactorily devised a pool table in which the ball pockets are grouped along opposite sides of the intermediate playing area of an oval-shaped or elliptical table, and opposite ends of the table are employed solely for the purpose of banking the object balls into one of the selected ball pockets

SUMMARY OF THE INVENTION

Accordingly, it is an object of the present invention to provide for a novel and improved billiard table having a unique arrangement of ball pockets therein.

It is another object of the present invention to provide for a billiard table of oval-shaped or elliptical configuration in which the ball pockets are so arranged as to create unique shot selections.

It is further object of the present invention to provide for a novel and improved billiard table which is of simplified construction, easy to assemble and may be constructed in different sizes according to its intended use in residential or commercial establishments.

In accordance with the present invention, a pocket billiard table has been devised of the type including a horizontal playing surface of generally oval-shaped or elliptical configuration with opposite ends and an intermediate playing area formed between the opposite ends of the playing surface, a cushion member extending continuously around an outer peripheral edge of the playing surface, and ball pockets are formed at spaced intervals so as to be closely grouped only along opposite sides of the intermediate area of the playing surface and away from the opposite ends. Preferably, the ball pockets are arranged such that three ball pockets are equally spaced and recessed into the cushion member along each of the opposite sides of the intermediate playing area and with the center ball pocket on each side intersected by the minor axis of the playing surface.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
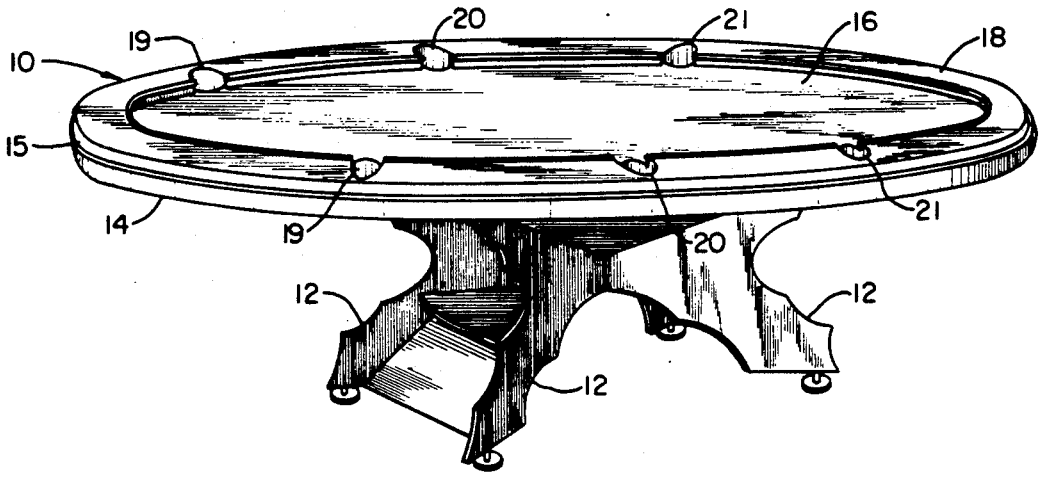
FIG. 1 is a somewhat perspective view of a preferred form of a pocket billiard table in accordance with the present invention.
Figure 2:
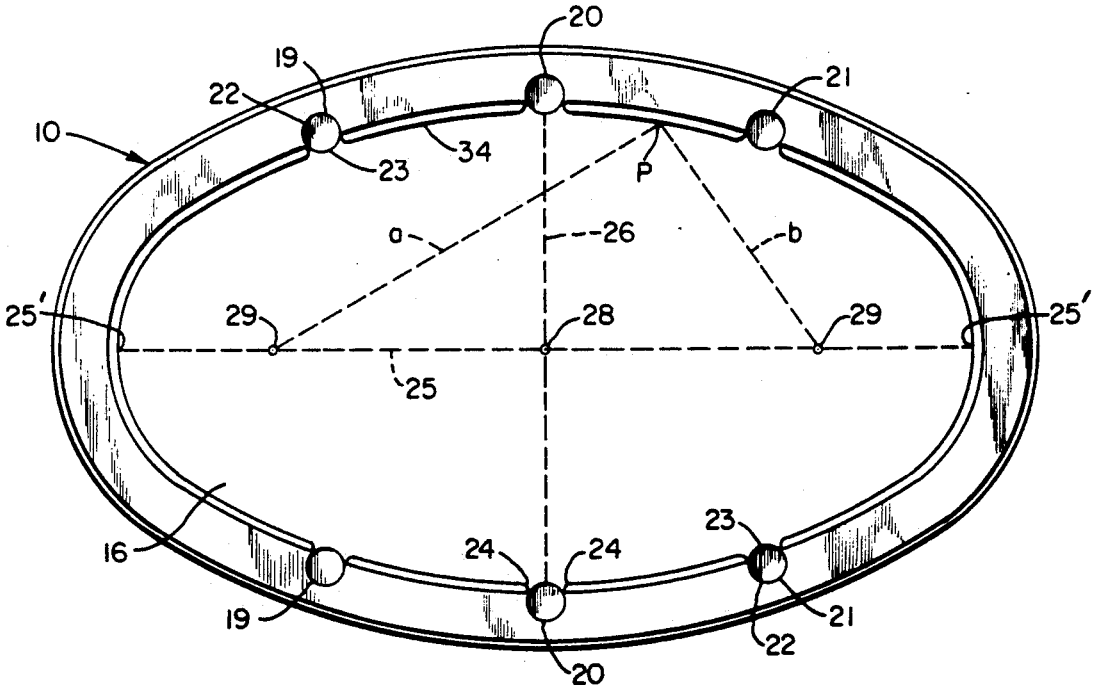
FIG. 2 is a top plan view thereof.

Referring in more detail to the drawings, there is illustrated in FIGS. 1 to 3 a preferred form of pocket billiard table 10 having conventional legs 12, an upper frame 14 supported on the legs, the frame including an outer rail 15 which is of elliptical configuration and disposed in surrounding relation to an elliptical playing surface 16. A continuous cushion 18 is mounted for extension around the rail so as to rest on the playing surface, and ball pockets 19, 20 and 21 are evenly spaced in a manner to be described so as to be closely grouped on opposite sides of an intermediate playing area of the playing surface 16.

In the preferred form, the legs 12 and frame 14 may be of wood construction, and the outer rail 15 may be formed of a one-piece Formica strip extending around the outer peripheral edge of the playing surface. The upper framework may be suitably composed of a one-piece particle board having an upper layer of Formica and which is covered by a felt material. In turn, the cushion 18 is of a rubber or rubber-like material and of the type used in cushion constructions for standard pool tables and also is covered with felt. The individual ball pockets 19, 20 and 21 each consists of a standard one-piece cup employed in conventional pool table constructions which is inserted through a recessed portion 22 in the cushion and through an aligned opening 23 in the playing surface directly beneath the cushion 18 with the upper edge of the cup defining a generally semi-circular opening with a slightly flared entrance 24 for passage of the object ball into the cup.

An important feature of the present invention resides in the disposition and relationship between the ball pockets 19 to 21 and the playing surface 16. In the elliptical configuration of the playing surface as shown, the playing surface has a major axis as represented by an imaginary center line 25, and a minor axis as represented by an imaginary line 26 perpendicular to the major axis and intersecting the major axis at the center point 28 of the playing surface. An ellipse may be defined as the locus of a point P which moves so that the sum of its undirected distances from two fixed points is a constant. In FIG. 2, the fixed points or foci 29 are equidistant from and relatively near opposite ends 25' of the playing surface 16 so that as the point P moves in accordance with the definition will trace the ellipse as shown. In other words, the sum of lines a and b between the foci 29 and point P will remain a constant.

The intermediate playing area, as referred to earlier,, is that section formed between the two ends 25' with opposite sides 34 being formed on a more, gradual curve than the curvature of each end 25'. If desired, the radius of curvature of the rail or cushion along the intermediate playing area may be a much gentler curve almost to the extent of being a substantially straight surface between the opposite ends 25' so as to be of generally oval-shaped configuration.

The ball pockets 19, 20 and 21 are grouped along each side 34 of the intermediate playing area as shown with the center ball pockets 20 located on the minor axis 26, and the end pockets 19 and 21 are located between imaginary lines drawn perpendicular to the major axis 25 and passing inwardly of the foci 29 so as to be located inwardly and away from the opposite ends 25'. In the preferred form, each of the pockets 19 and 21 is formed at the intersection of an imaginary line, not shown, drawn through the midpoint between the center point 28 and each opposite end 25 and extending perpendicular to the major axis 25.

The pool table as described may be used in playing various types of standard pool games, such as, eight-ball, rotation or 14.1; or special games may be played taking advantage of the unique characteristics of the table. For example, the angle of approach to the different pockets departs substantially from that of the standard table and requires considerable accuracy and skill in playing bank shots off of different locations on the cushion 18 and particularly along opposite ends 25 of the table.

In a typical pool table, the outside dimensions of the rail may be 6'×10' and the dimensions of the playing area 5'×9'. Thus, the center point, 28 would be located 4.5' between opposite ends 25' of the playing surface, and the foci 29 would be located near the opposite ends 25' in establishing the curvature of the table as described. As noted earlier, the ball pockets or cups 19 to 21 are of conventional construction and size corresponding to a regulation pool table which is a 4.5'×9' rectangular table.

It will be appreciated that various modifications may be made in the composition of materials and construction of the table itself and that the size of the playing surface 16 is given more for the purpose of illustration and not limitation. Moreover, the ball pockets may be given different specific configurations and spacings so long as the opposite ends 25 are devoid of any ball pockets and can present an uninterrupted area for banking an object ball toward one of the selected pockets 19 to 21.

It is therefore to be understood that while a preferred form of pool table has been herein set forth and described, various modifications and changes may be made therein without departing from the spirit and scope of the present invention as defined by the appended claims.

I claim:

1. In a billiard table including a flat, horizontal, continuous playing surface of generally oval-shaped configuration, said playing surface having opposite ends, an intermediate playing area formed between said opposite ends, said playing surface having a major axis and a minor axis perpendicular to the major axis and a pair of foci on said major axis equidistant from said opposite ends, and a cushion member extending continuously around an outer peripheral edge of said playing surface, the improvement comprising:

ball pockets formed at spaced intervals only along opposite sides of said intermediate area of said playing surface between imaginary lines extending perpendicular to said major axis and between said foci.

2. In a billiard table according to claim 1, said ball pockets formed at equally spaced intervals to one another along said cushion member on said opposite sides of said intermediate playing area.

3. In a billiard table according to claim 2, there being three ball pockets at equally spaced intervals along each of said opposite sides of said intermediate playing area.

4. In a billiard table according to claim 1, said cushion member being recessed to define an upper surrounding edge aligned with an opening in said playing surface to define each of said ball pockets.

5. A pocket billiard table comprising:

a flat, horizontal, continuous playing surface of generally elliptical configuration, said playing surface having a major axis and opposite ends having radii of curvature formed about spaced foci on said major axis, and an intermediate playing area formed between said opposite ends;

a cushion member extending continuously around an outer peripheral edge of said playing surface; and ball pockets formed at spaced intervals only along said intermediate area of said playing surface in said cushion member and away from said opposite ends, all of said ball pockets located between imaginary lines extending perpendicular to said major axis and between said foci.

6. A pocket billiard table according to claim 5, said ball pockets formed at equally spaced intervals to one another along opposite sides of said intermediate playing area.

7. A pocket billiard table according to claim 6, there being three ball pockets at equally spaced intervals along each of said opposite sides of said intermediate playing area.

8. A pocket billiard table according to claim 7, including ball pockets in said cushion member intermediately between said opposite ends and said center point.

9. A pocket billiard table according to claim 5, a pair of said ball pockets disposed on opposite sides of said intermediate playing area and intersected by said minor axis.

10. A pocket billiard table according to claim 9, a pair of said ball pockets equally spaced from each of said ball pockets on said minor axis, each of said pair of ball pockets disposed at the intersection of an imaginary line drawn through a midpoint between said center point and each of said opposite ends and said imaginary line extending perpendicular to said major axis.

11. A pocket billiard table according to claim 5, said cushion being recessed to define an upper surrounding edge of each of said ball pockets.

* * * * *